US005201208A

United States Patent [19]

Jacobson

[11] Patent Number: 5,201,208

[45] Date of Patent: Apr. 13, 1993

[54] COILING POINT HOLDER FOR SPRING COILING MACHINE

[75] Inventor: John D. Jacobson, Southington, Conn.

[73] Assignee: Newcomb Spring Corporation, Southington, Conn.

[21] Appl. No.: 787,577

[22] Filed: Nov. 4, 1991

[51] Int. Cl.[5] ..... B21F 3/02

[52] U.S. Cl. ..... 72/140; 72/135; 403/362; 403/354

[58] Field of Search ..... 72/140, 141, 142, 143, 72/144, 145, 135, 137, 138, 139, 133; 140/124; 403/361, 362, 354; 279/149, 152, 154, 155, 156, 902

[56] References Cited

U.S. PATENT DOCUMENTS

| | | | |
|---|---|---|---|
| 1,871,349 | 8/1932 | Wadsten | 72/141 |
| 1,953,830 | 4/1934 | Park | 279/156 |
| 2,119,002 | 5/1938 | Bergevin et al. | 72/145 |
| 3,202,433 | 8/1965 | Davis | 403/362 |
| 3,342,052 | 9/1967 | Boy | 72/140 |
| 3,934,445 | 1/1976 | Lampietti | 72/138 |
| 4,798,072 | 1/1989 | Vanmeggelen et al. | 72/138 |
| 4,917,530 | 4/1990 | Engelhardt et al. | 403/361 |
| 5,032,043 | 7/1991 | Hollifield | 279/156 |

*Primary Examiner*—Lowell A. Larson
*Assistant Examiner*—Michael J. McKeon
*Attorney, Agent, or Firm*—Chilton, Alix & Van Kirk

[57] ABSTRACT

A coiling point holder for a spring making machine precisely fixes the angular and axial position of the coiling point relative to the holder and allows for the pre-established coiling point positions to be replicated upon reversing or replacing the coiling point. The angular position of the coiling point is fixed by a diametral slot of an insert which is angularly fixed in the holder.

19 Claims, 2 Drawing Sheets

COILING POINT HOLDER FOR SPRING COILING MACHINE

BACKGROUND OF THE INVENTION

This invention relates generally to spring coiling machines which form springs in an automated process. More particularly, the present invention relates to spring coiling machines which are capable of feeding a wire from a feed roll in continuous fashion and forcing said wire against a coiling point to form a generally helical coiled spring.

The basic construction and operating principles for spring coiling machines to which the invention relates are conventional and generally parallel those set forth in representative U.S. Pat. No. 2,119,002 issued on May 31, 1938, for "Spring Coiling Machine" and U.S. Pat. No. 2,831,570, issued on Apr. 22, 1958 for "Wire Coiling Machine Having Cams for Holding the Feed Rolls Separated". The coiling machine described in U.S. Pat. No. 2,119,002 has various features which permit the operator to adjust the settings and cam-controlled movement of various tools and devices that determine the ultimate characteristics of the fabricated coil springs.

The conventional wire coiling machines to which the invention relates employ a tool holder or chuck. The chuck mounts an arbor as well as a block wire guide. The coiling machine may have multiple feed rolls which supply wire of various diameters or qualities. For a given work order, a wire having a pre-established diameter or quality is selected and the wire is fed along a path from the selected feed roll to the wire block guide.. The arbor, which is mounted in the chuck, extends outwardly from the plane of the front panel of the machine.

A coiling point contacts the wire as it emerges between the arbor and the block wire guide and deformably bends the wire into a generally helical shape. Substantially identical coiling points are typically disposed at opposing ends of a coiling point bar which is clamped into a point holder. The point holder is adjustably positionable in the machine to produce the desired dimensions and helical configuration of the spring. The coiling point member is periodically reversed or replaced. The tapered coiling point ends may conventionally be oriented and fixed at any angular position in the holder. The coiling point angle must be adjusted to obtain the proper angular orientation for a given application. Conventionally, the coiling point is positioned at the proper position and then clamped in the holder. The efficient and precise setting of the angle of the coiling point during the machine set-up phase or when the point is replaced is a recurring problem in conventional spring making machines.

SUMMARY OF THE INVENTION

Briefly stated, the invention in a preferred form is a coiling point holder for a spring making machine. The holder is adapted for receiving coiling point members of a type having a cylindrical bar-like form with a pair of opposed tapered ends which are engaged by the wire workpiece for coiling the wire into a coiled spring. The holder body forms an axial opening for receiving the coiling point member. The inner end of the opening terminates in an axial bore. An insert or position pin is received in the bore and is angularly positionable therein. The pin may be a cylindrical plug-like member which has a diametral slot at one end. One of the tapered ends of the coiling point is engageable in the pin slot so as to fix the angular orientation of the working coiling point. A set screw is threadable to the holder body and engageable against the pin for fixing the pin at the fixed angular position. A clamp includes a clamp plate which clamps the coiling point member to the holder body at the fixed pre-established angle. The clamp plate and the holder body include a pair of opposed axial grooves. The coiling point member is captured between the grooves. A pair of bolts thread into the holder body and are torqueable to clamp the clamp plate against the coiling point member.

An object of the invention is to provide a new and improved coiling point holder apparatus for a spring coiling machine.

Another object of the invention is to provide a new and improved coiling point holder apparatus wherein the proper angle of the coiling point may be obtained and/or adjusted in an efficient manner.

A further object of the invention is to provide a new and improved coiling point holder apparatus for a spring coiling machine wherein the angle and position of the coiling point relative to the holder is replicatable upon replacement or reversal of the coiling point member.

Other objects and advantages of the invention will become apparent from the specification and the drawings.

DETAILED DESCRIPTION OF THE PREFERRED EMBODIMENT

Figure 1:
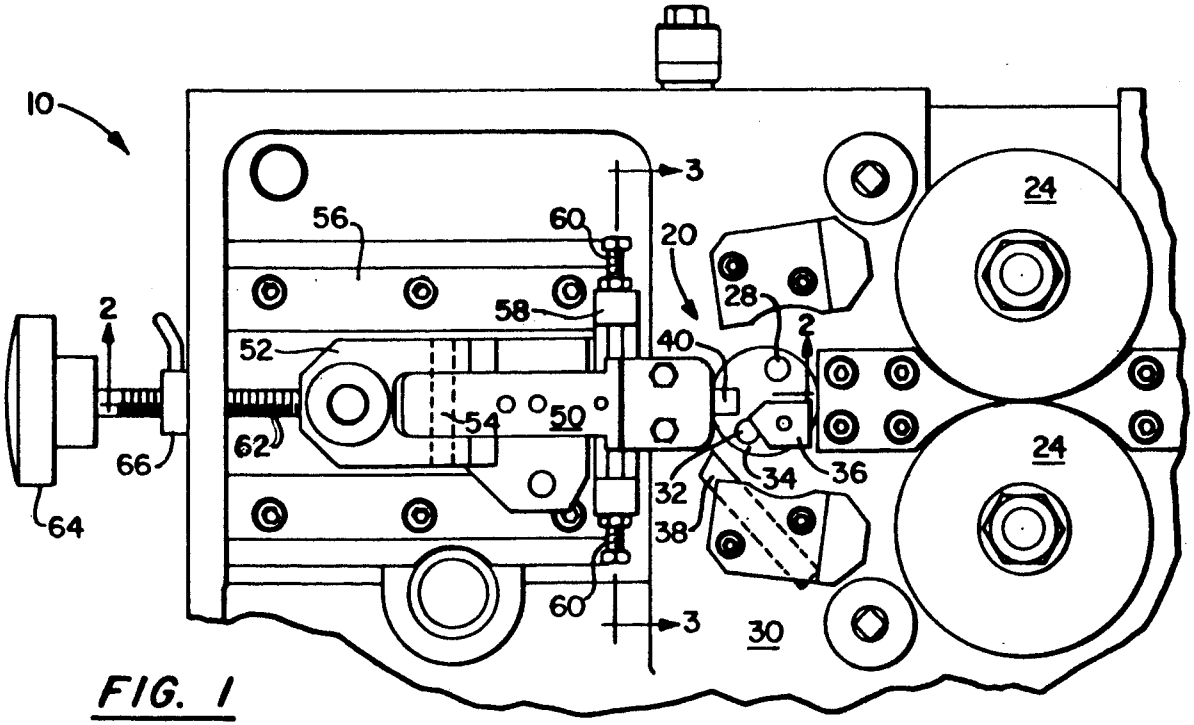
FIG. 1 is a fragmentary frontal view, partly broken away and partly in phantom, of a spring coiling machine incorporating the coiling point holder apparatus of the present invention.

With reference to the drawings wherein like numerals represent like parts throughout the several figures, a spring coiling machine for which the invention is particularly adapted is generally designated by the numeral 10. Spring coiling machine 10 may be any of numerous makes and models which are employed for manufacturing coil springs in an automatic highly efficient process. A preferred embodiment which is employed for describing the present invention is a single point spring coiling machine such as the Model W-11A springmaker marketed by the Torin Corporation of Torrington, Connecticut. It should be understood that the principles and advantages of the invention are applicable to other makes of coiling machines. The basic described in U.S. Pat. No. 2,119,002, the disclosure which is hereby incorporated by reference.

The spring coiling machine 10 employs a multiplicity of gears, linkages, levers, cams and power supplies, all of which are operatively integrated for the purposes of feeding a wire through to a coiling station 20. The wire is plastically deformed at the coiling station into a coil spring having desired characteristics such as diameter, length and pitch which may vary for a given coil. The coil spring is then severed from the supply wire. The manufacturing sequence is continuously replicated so that multiple coil springs are produced without any interruption in a highly efficient manufacturing process.

The coiling station 20 operates on the workpiece in the form of a continuous wire to produce the coil spring. The supply of wire is displaced by feed rolls 24 through a wire guide and a block wire guide 28. The wire is continuously displaced generally parallel to the front face of panel 30 of the machine until it reaches the arbor 32. The arbor 32 and the block wire guide 28 are mounted to a tool holder or chuck 34 which is mounted through the front panel 3 and clamped into position.

A coiling point 40 contacts the wire as it emerges from in between the arbor 32 and the block guide 28 and deformably forces the wire into a generally helical shape. A pitch tool 36 is conventionally wedged at an angle to the wire thereby establishing the pitch of the successive loops or turns in the coil. When the spring reaches the desired number of turns or links, a cutting tool in the form of a tension assembly having a projecting cutting blade 38 is actuated. The blade 38 is pivotally displaced to sever the feed wire against the arbor 32 and thereby complete the fabrication of the coil spring.

Figure 2:
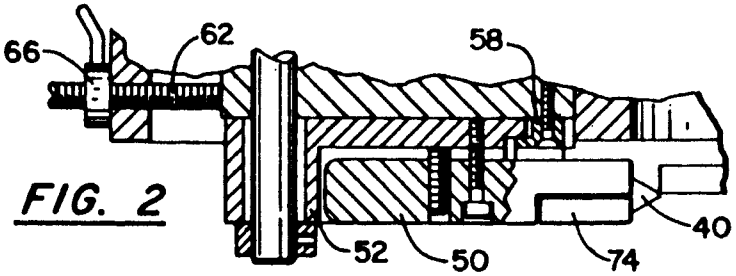
FIG. 2 is a top fragmentary sectional view of the coiling point holder apparatus and the spring coiling machine of FIG. 1 taken along the line 2—2 thereof.
Figure 3:
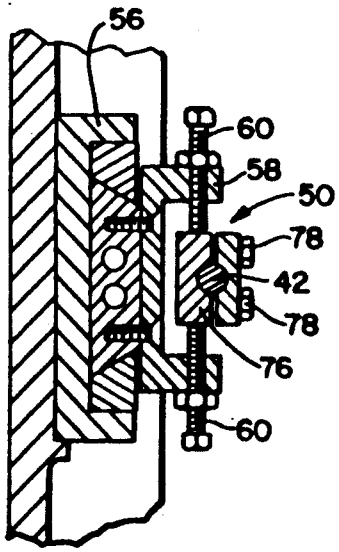
FIG. 3 is a fragmentary sectional view of the coiling point holder apparatus and the spring coiling machine of FIG. 1 taken along the line 3—3 thereof.
Figure 4:
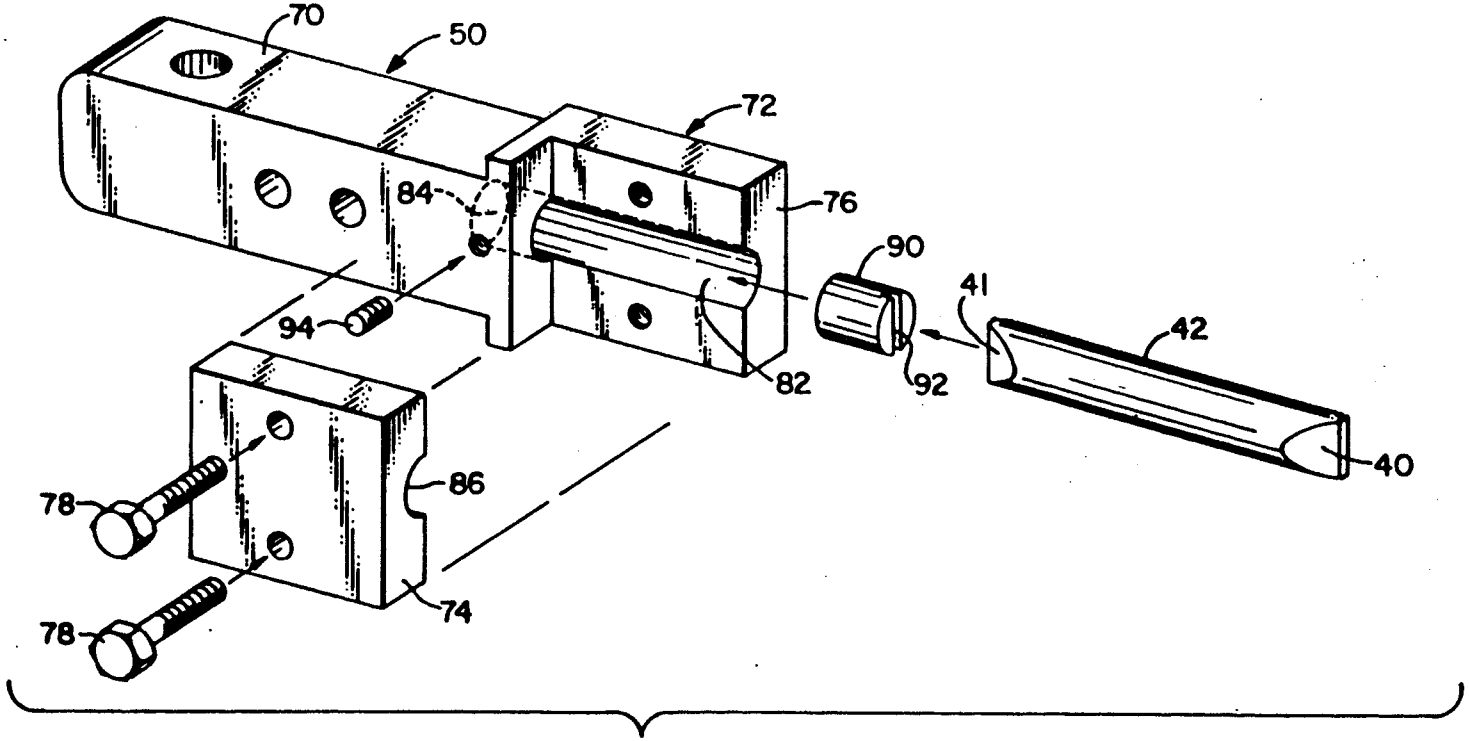
FIG. 4 is an enlarged exploded view of the coiling point holder apparatus and coiling point of FIG. 1.

With reference to FIG. 4, the coiling point 40 is a tapered terminus of a bar-like point member 42 which ordinarily has identical points 40 and 41 at each opposing end. The point member 42 is received and fixed in position by a coiling point holder 50. The working coiling point 40 projects forwardly into the coiling station and the non-working coiling point 41 is enclosed in the holder 50. With additional reference to FIGS. 1-3, the coiling point holder 50 is slidably received in a coiling point holder block 52 and is retained therein by a coiling point holder pin 54. The coiling point holder block is mounted in a diameter slide block 56. The front portion of the holder 50 is secured in a precise position by means of the coiling point bracket 58 which mounts an opposed pair of position screws 60. The position of the coiling point block 52 is governed by a diameter adjustment screw 62 which is set by a diameter adjustment knob 64 and locked by a lock nut 66.

With reference to FIG. 4, in accordance with the invention, the point holder 50 has a bifurcated configuration including a rear slider arm 70 for mounting the holder and a forward enlarged head 72 for receiving and securing the coiling point member 42. The head 72 includes a clamp plate 74 which is secured to a fixed base 76 by means of a pair of clamp bolts 78. The base 76 has an axial groove 82 which rearwardly terminates in a cylindrical bore 84. The curvature of the groove 82 is generally complementary with the cylindrical surface of the coiling point member 42. The clamp plate also includes an axial groove 86 which has a curvature generally complementary with the surface of the coiling point member 42. The grooves cooperate to form an axial opening for the point member 42. The axial opening has a variable diameter which can be suitably restricted to firmly secure the coiling point member in the holder so that the working coiling point 40 projects forwardly from the holder 50.

An insert in the form of a position pin 90 is insertable into bore 84. The pin 90 has a cylindrical plug-like form with a forward diametral slot 92. The slot 92 is dimensioned to receive and engage opposing tapered surfaces of the non-working coiling point 41 of the coiling point member 42 so as to angularly couple therewith to thereby fix the angle of the working coiling point 40. The pin 90 has a pre-established axial length which determine the axial position of the working coiling point 40 when the non-slotted end of the pin engages the end of the bore 84 to define a reference position. The angular position of the slot 92 may be selectively obtained and then fixed by means of a set screw 94 threaded into the side of the holder. The coiling point member is then inserted into the axial holder opening until the non-working inner point 41 is seated in the pin slot 92. The clamp bolts 78 are torqued so that the clamp plate clamps against the coiling point member to firmly secure the coiling point member in position within the holder.

It will be appreciated that the angular position of the position pin slot 92 defines the angular position of the coiling point, and in addition, the axial position of the pin slot 92 defines the axial position of the coiling point. Consequently, should it be necessary to replace or reverse the coiling point, both the axial and the angular positions of the coiling point can be efficiently replicated.

Figure 5B:
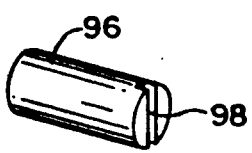
FIG. 5B is an enlarged perspective view of a second pin for the holder apparatus of FIG. 4.
Figure 5A:
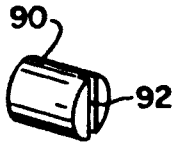
FIG. 5A is an enlarged perspective view, of a pin for the holder apparatus of FIG. 4.

A different axial position of the coiling point may be pre-established by selecting a position pin 96 which has a greater axial length such as illustrated in FIG. 5B. The slot 98 may have the same geometry as slot 92 or may be dimensioned to engage a coiling point having different dimensions than coiling point 41 so s to angularly coupled with the point member. Naturally, pins of various other axial dimensions may also be provided. The selective employment of coiling point pins of different pre-established axial lengths represents an efficient means of providing for both a replicatable axial coiling point position as well as efficient means for implementing the replicated position.

The foregoing coiling point holder 50 provides a very labor efficient and accurate means for implementing a proper replicatable axial and angular alignment of the coiling point. Moreover, a precise angular and axial position of the coiling point may be pre-established prior to securing and clamping the coiling point in position in the holder. The coiling point may thus be reversed or replaced in an efficient manner while maintaining the optimum pre-established position in the machine. In addition, the angular and axial position of the coiling point can be also readjusted in an efficient and repeatable manner by suitable selection and positioning of the position pin.

While a preferred embodiment of the invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A coiling point assembly for a spring making machine comprising:

coiling point means having a pair of opposed tapered ends adapted for engagement by a wire for coiling said wire;

holder means defining an axial groove for receiving said coiling point means;

insert means receivable in said groove and freely angularly positionable therein, at a given axial position of said groove, said insert means comprising a cylindrical plug comprising slot means defining a diametral slot for engaging one end of said coiling point means at a fixed angular position thereof;

fixing means for fixing said first insert means at a fixed angular position of said holder means; and clamp means for clamping said coiling point means to said holder means at said pre-established fixed angular position.

2. The coiling point assembly of claim 1 wherein said fixing means comprises a set screw threaded to said holder means.

3. The coiling point assembly of claim 1 wherein said holder means has means defining an axial bore adjacent said groove.

4. The coiling point assembly of claim 1 wherein said clamp means further has a groove which cooperates with said holder groove to define at least a portion of said axial groove.

5. The coiling point assembly of claim 1 further comprising reference means for defining an axial reference position for said insert means.

6. The coiling point assembly of claim 5 wherein said holder means defines an axial bore having an end surface and said reference means comprises said end surface.

7. The coiling point assembly of claim 1 further comprising second insert means receivable in said opening and angularly positionable therein, said second insert means comprising seating means for engaging one end of said coiling point means at a fixed angular position thereof, each said insert means having a different axial length.

8. A coiling point assembly for a spring making machine comprising:

coiling point means having a pair of opposed tapered ends adapted for engagement by a wire for coiling said wire;

holder means defining an axial groove for receiving said coiling point means;

first insert means receivable in said groove and freely angularly positionable therein at a given axial position of said groove, said first insert means comprising first seating means for engaging one end of said coiling point means at a fixed angular position thereof;

second insert means receivable in said groove and freely angularly positionable therein, said second insert means, comprising second seating means for engaging one end of said coiling point means at a first angular position thereof, each said insert means having a different axial length;

fixing means for fixing said first and second insert means at a fixed angular position of said holder means; and clamp means for clamping said coiling point means to said holder means at the pre-established fixed angular position.

9. A coiling point assembly for a spring making machine comprising:

coiling point means comprising a cylindrical portion and a pair of opposed tapered ends adapted for engagement by a wire for coiling said wire;

holder means defining an axial bore and a contiguous axial opening for receiving said coiling point means;

insert means receivable in said bore and freely angularly positionable therein at a given axial position thereof, said insert means comprising a cylindrical plug and seating means for engaging one end of said coiling point means at a fixed angular position thereof, said seating means comprising slot means for defining a diametral slot at one end of said plug;

fixing means for fixing said insert means at a fixed angular position of said holder means; and clamp means for clamping said coiling point means to said holder means at said pre-established fixed angular position.

10. The coiling point assembly of claim 9 wherein said fixing means comprises a set screw threaded to said holder means and engageable against said insert means.

11. The coiling point assembly of claim 9 wherein said holder means and said clamp means each have an axial groove and said cylindrical surface is captured between said grooves.

12. The coiling point assembly of claim 9 wherein said clamp means further comprises a plate having an axial groove and a pair of bolts threadably engageable in said holder means.

13. The coiling point assembly of claim 9 further comprising reference means for defining an axial reference position for said insert means.

14. A coiling point holder for a spring making machine comprising:

holder means comprising first means defining a first axial groove for receiving a coiling point and second means defining a second fixed bore contiguous with said first groove, said second bore having a closed end;

insert means receivable in said second bore for engagement against said closed end at a first axial position and freely angularly positionable in said second bore at said first axial position, said insert means comprising seating means defining a diametral slot for engaging one end of said coiling point means at a fixed angular position thereof;

fixing means for fixing aid insert means at a fixed angular position of said holder means; and clamp means for clamping a coiling point received in said first opening to said holder means at said pre-established fixed angular position.

15. The coiling point holder of claim 14 wherein said insert means comprises a cylindrical plug, said diametral slot being disposed at one end of said plug.

16. The coiling point holder of claim 14 wherein said fixing means comprises a set screw threaded to said holder means and engageable against said insert means.

17. The coiling point holder of claim 14 wherein said holder means and said clamp means further comprise a pair of opposed axial grooves.

18. The coiling point holder of claim 14 wherein said clamp means further comprises a clamp plate and a pair of bolts extending through said clamp plate and threadably engageable in said holder means.

19. The coiling point holder of claim 14 wherein said insert means has a first axial length and further comprising a second insert means having a second axial length different from said first length, said second insert means receivable in said second opening and angularly positionable therein and comprising securing means for defining a diametral slot for engaging one end of said coiling point means at a fixed angular position thereof.

* * * * *